US005665293A

United States Patent [19]

Karageorgiou et al.

[11] Patent Number: 5,665,293

[45] Date of Patent: Sep. 9, 1997

[54] METHOD OF MAKING SPUN YARN PACKAGES MULTIPLE INDIVIDUALLY SEPARABLE YARN ENDS

[75] Inventors: Theodore G. Karageorgiou, Arden, N.C.; Gary W. Hanwell, Anderson, S.C.; David L. Caldwell, Greenville, S.C.; Jewell D. Purvis, Anderson, S.C.; Jerry M. Walker, Pendleton, S.C.; Freddie L. Banks, Belton, S.C.; Charles E. Eatmon, Mars Hill; Otto M. Ilg, Asheville, both of N.C.; Eugene Carnes, Star, S.C.; James A. Hucks, Anderson, S.C.; James F. Coker, Anderson, S.C.; Carl R. Holzer, Anderson, S.C.; John E. Emery, II, Anderson, S.C.; David M. Pendley, Anderson, S.C.; Dennis W. Pomeroy, Westminster, S.C.; Richard Arnold, Greenville, S.C.; Billy K. Osborne, Hartwell, Ga.; Philip T. Earley, Anderson, S.C.; John M. Temples, Hartwell, Ga.; Larry D. Blackston, Pendleton; Thomas M. Toney, Anderson, both of S.C.

[73] Assignee: BASF Corporation, Mt. Olive, N.J.

[21] Appl. No.: 613,143

[22] Filed: Mar. 8, 1996

[51] Int. Cl.[6] ..... C01D 5/12; D02J 1/08

[52] U.S. Cl. ..... 264/103; 28/220; 28/271; 264/130; 264/210.8; 264/211.14

[58] Field of Search ..... 264/103, 130, 264/210.8, 211.14; 28/220, 271

[56] References Cited

U.S. PATENT DOCUMENTS

| | | | |
|---|---|---|---|
| 2,014,530 | 9/1935 | Kinsella et al. | 66/210 |
| 2,285,667 | 6/1942 | Kontz, Jr. | 242/128 |
| 2,718,748 | 9/1955 | Colbeck et al. | 57/125 |
| 2,788,634 | 4/1957 | Crouzet | 57/352 |
| 2,999,654 | 9/1961 | Fuller | 242/128 |
| 3,822,833 | 7/1974 | Fecker | 242/47.12 |
| 4,226,378 | 10/1980 | Fitzgerald et al. | 242/18 G |
| 4,334,653 | 6/1982 | Whellams | 242/129.8 |
| 4,487,009 | 12/1984 | Winkelmann | 57/58.86 |
| 4,488,686 | 12/1984 | Reese | 242/18 G |
| 4,523,424 | 6/1985 | Hoover | 57/125 |
| 4,693,429 | 9/1987 | Billard et al. | 242/18 G |
| 4,856,268 | 8/1989 | Colli | 57/58.52 |
| 5,299,345 | 4/1994 | Flachmueller et al. | 28/220 |
| 5,524,841 | 6/1996 | Rijk et al. | 242/42 |

FOREIGN PATENT DOCUMENTS

| | | |
|---|---|---|
| 52-22622 | 2/1977 | Japan . |
| 1201360 | 8/1970 | United Kingdom . |

*Primary Examiner*—Leo B. Tentoni
*Attorney, Agent, or Firm*—Nixon & Vanderhye P.C.

[57] ABSTRACT

A generally cylindrical yarn package having multiple yarn ends is formed by converging the multiple yarn ends to form a substantially planar yarn end ribbon having the multiple yarn ends in a side-by-side untwisted contacting relationship with one another. The yarn end ribbon formed of the converged yarn ends is then wound about a continuously rotating yarn package core by reciprocally traversing the yarn end ribbon parallel to the longitudinal axis of the yarn package core while maintaining the side-by-side untwisted contacting relationship between the multiple yarn ends of the yarn end ribbon. In such a manner, a generally cylindrical yarn package is formed having multiple yarn ends which may later be separated into individual yarn ends for downstream processing by tangentially unwinding and separating the individual yarn ends from the yarn package. As a result, the present invention allows an increase in spinning capacity to be achieved (i.e., since a greater number of yarn ends may be produced) without the need for additional substantial capital investment for new individual winders.

16 Claims, 2 Drawing Sheets

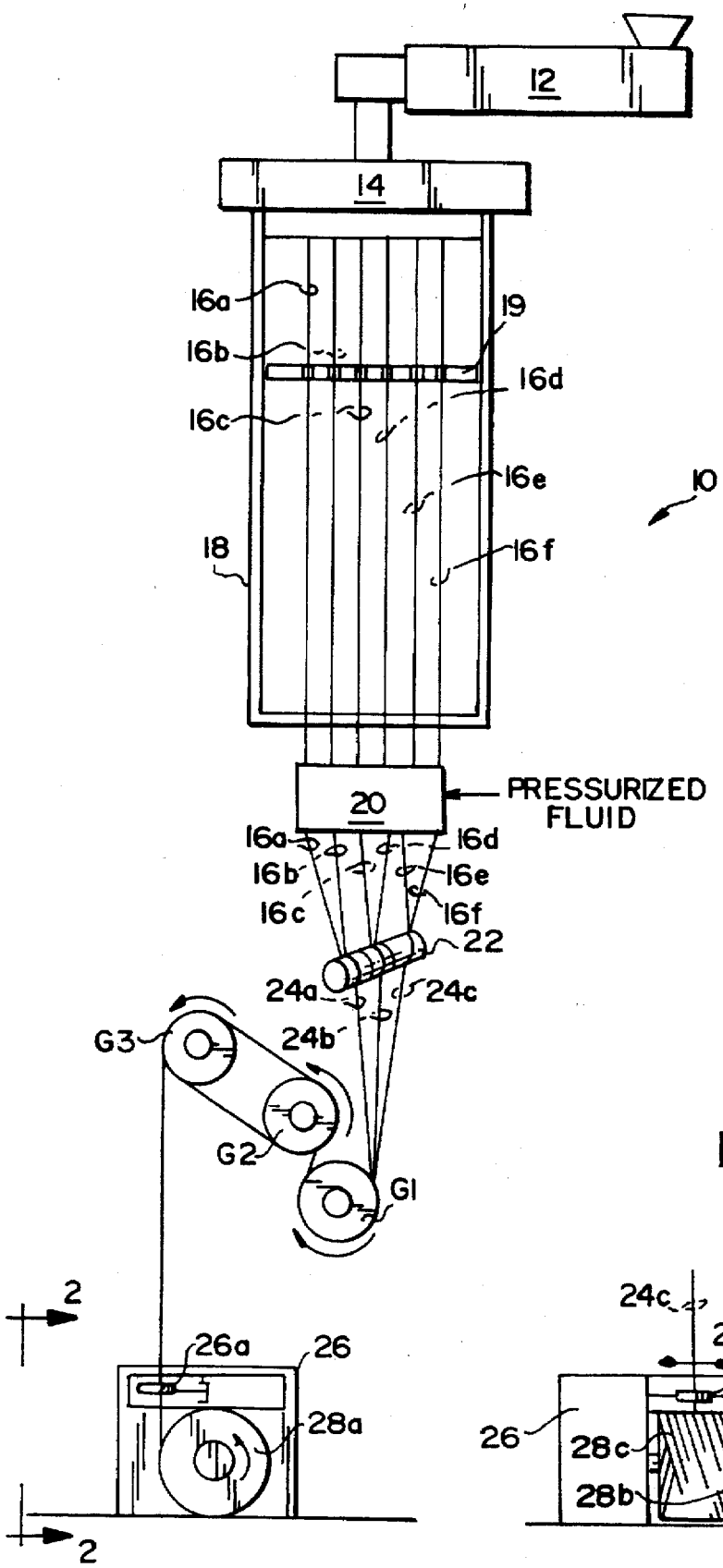
FIG. 1
FIG. 2
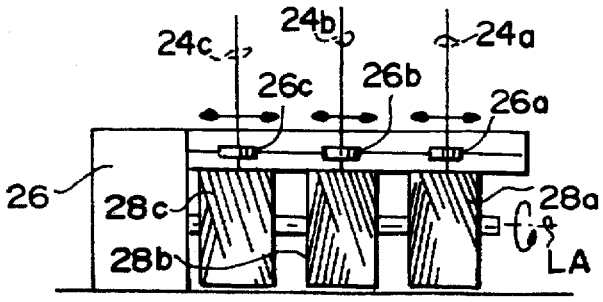

METHOD OF MAKING SPUN YARN PACKAGES MULTIPLE INDIVIDUALLY SEPARABLE YARN ENDS

FIELD OF INVENTION

The present invention generally relates to the field of synthetic filament production. In its preferred form, the present invention relates to the production of melt-spun yarns which am helically wound to form a generally cylindrical yarn package.

BACKGROUND AND SUMMARY OF THE INVENTION

Yarns composed of multiple filaments are traditionally produced by melt-spinning techniques whereby a melt-spinnable polymer is extruded through relatively small-sized orifices in a spin pack to form a stream of filaments which are substantially immediately solidified in a quench cabinet and converged after solidification to form a yarn composed of multiple filaments. The yarn is thereafter continuously taken up by a high speed winder to form a generally cylindrical yarn package. Depending on the intended end use, the yarn may be flat (undrawn) or may be subjected to a drawing step prior to being taken up to form the package.

During take-up, the yarn end is guided through a traversing arm associated with the high speed winder. The traversing arm reciprocates at relatively high speed linearly parallel to the longitudinal axis of a rotating yarn package core. As a result, the traversing arm causes the yarn end guided thereby to be wound in alternating layers of reverse helical directions about the core as the yarn package is "built" (i.e., as the radial dimension of the yarn package increases due to the yarn end being wound thereabout in alternating reverse helical layers).

Because of the linear traversing arm associated with automated winders, it has been the conventional wisdom in this art that only a single yarn end may be wound around the yarn package core. That is, it has been considered technically unfeasible to wind at multiple yarn ends around a single yarn package core since the traversing arm was thought to cause intermingling to occur between the multiple yarn ends. Such yarn end intermingling would thereby prevent them from later being separately unwound from the yarn package and used individually during downstream processing (e.g., as might be needed for beam warping, knitting or like operations requiring the use of multiple yarn ends).

Contrary to the conventional wisdom in this art, it has now been discovered that multiple yarn ends may be wound concurrently about a single yarn package core using conventional high speed winders without twisting occurring between the individual yarn ends. As a result, according to this invention, the multiple yarn ends comprising the yarn package may be individually unwound from the package and separated for purposes of downstream processing (e.g., beam warping, knitting and like operations).

More specifically, according to the present invention, multiple yarn ends, each of which includes a plurality of synthetic filaments, are converged in such a manner as to form a "ribbon" of the yarn ends—that is, the yarn ends are disposed in a substantially planar side-by-side mutually contacting untwisted relationship with one another. The converged yarn ends in the ribbon are then guided by the traversing arm during winding so as to maintain the side-by-side mutually contacting relationship with one another. In such a manner, therefore, the multiple yarn ends forming the ribbon are wound about the yarn package core in alternating helical turns to form a generally cylindrical yarn package. The individual yarn ends may thereafter be separated from one another by unwinding in a direction substantially tangential to the cylindrical yarn package.

The present invention therefore allows for increased production throughput to occur without requiring the considerable capital expense and/or spatial requirements of additional winders. Thus, greater yarn production may be accomplished using existing spinning systems without additional substantial capital investment.

These and further aspects and advantages of the present invention will become more clear after careful consideration is given to the following detailed description of the preferred exemplary embodiment thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein;

FIG. 1 is a schematic front elevational view of a yarn spinning and winding system according to the present invention;

FIG. 2 is a schematic side elevational view of a high speed winder that is employed in the system depicted in FIG. 1.

DETAILED DESCRIPTION OF THE PREFERRED EXEMPLARY EMBODIMENTS

Figure 3:
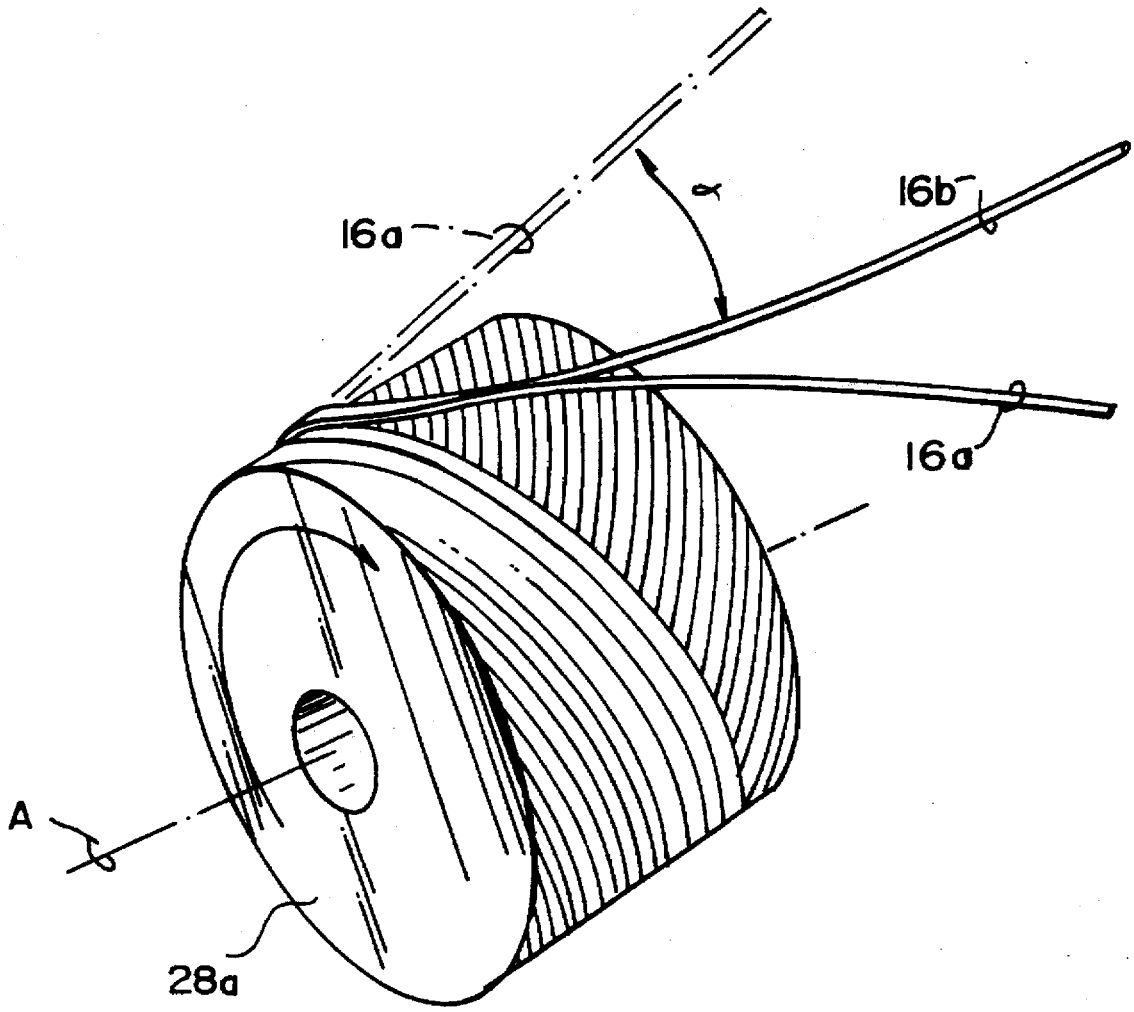
FIG. 3 is a schematic perspective view of an exemplary yarn package according to the present invention.

An exemplary spinning apparatus 10 for making melt-spun synthetic filaments is depicted schematically in accompanying FIG. 1. As shown, the yarn spinning apparatus 10 generally includes a polymer extruder 12 which melts and blends a melt-spinnable polymer (e.g., nylons such as nylon-6 and nylon-6,6, polyesters, and polyolefines such as polypropylene) and feeds a flow of the polymer melt to a spin pack 14. The spin pack is conventional in that it includes a plurality of grouped orifices through which the polymer melt is forced so as to form a corresponding plurality of yarn ends **16*a*–16*f*. In this regard, each of the yarn ends 16*a*–16*f* itself includes a plurality of individual filaments corresponding in number to the number of orifices in an orifice grouping within the spin pack 14. Furthermore, six yarn ends 16*a*–16*f* each composed of multiple (e.g., preferably six to twelve or more) individual filaments just happen to be depicted in FIG. 1. Thus, more or less than the depicted six yarn ends 16*a*–16*f* may be present for any given melt spinning apparatus 10**.

The individual filaments forming the yarn ends **16*a*–16*f* quickly solidify within the quench cabinet 18 downstream of the spin pack 14 and are brought into contact with a spin finish applicator 19 where a liquid finish oil is applied to the filaments to improve subsequent filament processing. The yarn ends 16*a*–16*f* are then passed through a conventional filament interlacer 20 which serves to increase the filament-to-filament cohesion between the individual filaments in each of the yarn ends 16*a*–16*f*. In this regard, it is preferred that the filament interlacer 20 be supplied with a pressurized fluid (e.g., air, steam, nitrogen or the like) which is brought to bear against each of the yarn ends 16*a*–16*f* within the interlacer 20 so as to cause the individual filaments of each yarn end 16a–16f to become intimately commingled with one another. It will be understood, however, that the yarn ends 16a–16f are not commingled with one another within the interlacer 20, but instead exit the interlacer 20** as coherent individually identifiable yarn ends.

Multiple ones of the yarn ends 16a–16f are then converged at the notched convergence bar 22 to form yarn end ribbons 24a–24c, respectively. In the embodiment shown, yam ends 16a and 16b are converged with one another to form yarn end ribbon 24a, while yarn ends 16c, 16d and 16e, 16f are converged to form yarn end ribbons 24b and 24c, respectively. Thus, in the embodiment shown, each of the yarn end ribbons 24a–24c will be comprised of a pair of the yarn ends 16a–16f. However, more than a pair of such yarn ends 16a–16f may be converged, in which case a lesser number of yarn end ribbons will be formed. Thus, for example, three of the yarn ends 16a–16f may be converged to form two yarn end ribbons.

The yarn end ribbons 24a–24c will thus each be comprised of multiple (e.g., a pair) yarn ends 16a–16f which are disposed in a substantially planar side-by-side mutually contacting, but untwisted, relationship with one another. The yarn end ribbons 24a–24c will thereafter be turned 90° by the convergence bar 22 and passed around a take-up godet roll G1 and then sequentially around godet rolls G2 and G3 which are rotated at different speeds so as to draw the filaments therebetween in the yarn ends 16a–16f forming the respective ribbons 24a–24c. Each of the yarn end ribbons 24a–24c is then directed to the high speed winding apparatus 26 where they are wound on separate cores to form separate yarn packages 28a–28c.

Specifically, as shown in FIG. 2, the yarn end ribbons 24a–24c are guided by a traversing arm 26a–26c associated with the winding apparatus 26 so as to form the yarn packages 28a–28c, respectively. In this regard, the traversing arm reciprocates linearly parallel to the central longitudinal axis LA (see FIG. 2) of the yarn packages 28a–28c concurrently with rotation of the yarn packages 28a–28c about such longitudinal axis LA. Thus, the traversing arms 26a–26c cause each of the yarn ribbons 24a–24c to be wound in alternating helical directions about the longitudinal axis. Over time, the yarn packages 28a–28c will therefore be built sufficiently to achieve a generally cylindrical form.

In the embodiment shown in the accompanying drawing FIGURES, the convergence bar 22 is depicted as being upstream of the Godet rolls G1–G3. However, in accordance with the present invention, the convergence bar could be positioned at any location downstream of the interlacer 20, but upstream of the winding apparatus 26, for example between the Godet roll G3 and the traversing arms 26a–26c of the winding apparatus 26.

According to the present invention, therefore, even though the traversing arms 26a–26c reciprocally traverse the widthwise dimension of the yarn packages 28a–28c (i.e., the dimension of the yarn packages parallel to the axis LA), the yarn ribbons 24a–24c are guided during take-up in such a manner as to maintain the side-by-side untwisted relationship. As such, the individual yarn ends may be unwound from the yarn packages and separated from one another for purposes of downstream processing as shown schematically in accompanying FIG. 3.

In this regard, yarn package 28a comprised of yarn ends 16a and 16b is shown schematically in accompanying FIG. 3 and is exemplary of the other yarn packages 28b and 28c. Unlike conventional yarn packages whereby only a single yarn end is wound about the package core, the yarn package 28a according to this invention includes at least a pair of yarn ends 16a and 16b which are wound about the package core in side-by-side relationship to form alternating layers of reverse helical turns. The yarn ends 16a and 16b are thus unwound from the yarn package 28a in a direction substantially tangentially to the yarn package's exterior cylindrical circumferential surface.

That is, the yarn ends 16a, 16b are unwound from the package 28a within planes that are tangential to the exterior cylindrical circumferential surface of the yarn package 28a and parallel to the longitudinal axis A of the yarn package 28a. The yarn ends 16a, 16b may thus be unwound in a common tangential plane as depicted schematically in FIG. 3. Alternatively, as shown by the phantom line depiction of yarn end 16a in FIG. 3, the yarn ends 16a, 16b may be unwound from the package 28a within respectively separate tangential planes separated from one another by an angle $\alpha$, each plane being parallel with the package's 28a longitudinal axis A.

Such tangential unwinding of the yarn ends 16a, 16b from the package 28a may be accomplished by rotating the yarn package 28a about its longitudinal axis A. Tangential unwinding of the yarn ends 16a, 16b therefore allows them to be separated from their side-by-side relationship so that each of the individual yarn ends 16a and 16b may be processed separately as needed. Such downstream processing may involve unwinding and separating each of the yarn ends 16a, 16b from the yarn package 28a and then rewinding each of the yarn ends 16a, 16b into individual separate yarn packages which are more suitable for conventional textile processing operations such as warping or knitting operations where the yarn may be unwound from the side of the yarn package—i.e., in the direction of the yarn package's longitudinal axis. Alternatively, in order to eliminate an intermediate unwinding/rewinding step (and its attendant processing costs), the yarn end may be tangentially unwound from the packages of this invention and used directly in conventional textile processing operations where multiple separate yarn ends are required, such as in warping or knitting operations.

The present invention has been described above in terms of a presently preferred embodiment wherein filaments forming the yarn ends are melt-spun. However, the present invention may equally be embodied in other filament spinning operations known in this art, such as, for example, dry spinning (wherein a solution of the fiber-forming material is extruded in a continuous stream into a heated chamber to remove the solvent leaving the solid filament) and wet spinning (wherein a solution of the fiber forming material is extruded into a liquid coagulating medium where the material is regenerated).

Thus, while the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method of forming a generally cylindrical yarn package comprised of multiple yarn ends comprising the steps of:

(a) converging multiple yarn ends to form a substantially planar yarn end ribbon having the multiple yarn ends in a side-by-side untwisted contacting relationship with one another; and (b) forming a generally cylindrical yarn package by winding the yarn end ribbon about a continuously rotating yarn package core., said winding including reciprocally traversing the yarn end ribbon parallel to the longitudinal axis of the yarn package core while maintaining the side-by-side untwisted contacting relationship between the multiple yarn ends of the yarn end ribbon.

2. The method of claim 1, wherein step (a) is practiced such that the yarn end ribbon is wound about the core in layers of alternating helical turns.

3. The method of claim 1, wherein the yarn end ribbon includes at least one pair of yarn ends, each of which includes multiple interlaced synthetic filaments.

4. The method of claim 3, wherein prior to step (a) there is practiced the step of interlacing the synthetic filaments forming each of said yarn ends.

5. The method of claim 4, wherein said step of interlacing is practiced using a pressurized fluid selected from pressurized air, steam or nitrogen.

6. The method of claim 1, wherein prior to step (a) there is practiced the step of applying a finish oil to filaments of the yarn ends.

7. The method of claim 1, wherein prior to step (b) there is practiced the step of drawing the multiple yarn ends.

8. The method of claim 7, wherein said converging step (a) is practiced prior to said drawing step.

9. The method of claim 7, wherein said converging step (a) is practiced after said drawing step.

10. A method of making generally cylindrical packages of melt-spun synthetic filaments comprising the steps of:

(a) spinning a melt-spinnable polymer through orifices to form at least a pair of yarn ends each comprised of a plurality of individual melt-spun filaments;

(b) solidifying the melt-spun filaments in a quench cabinet;

(c) interlacing the individual filaments forming each of the pair of yarn ends;

(d) converging the pair of yarn ends to form a substantially planar yarn end ribbon having the pair of yarn ends in a side-by-side untwisted contacting relationship with one another; and (e) forming a generally cylindrical yarn package by winding the yarn end ribbon about a continuously rotating yarn package core, said winding including reciprocally traversing the yarn end ribbon parallel to the longitudinal axis of the yarn package core while maintaining the side-by-side untwisted contacting relationship between the pair of yarn ends of the yarn end ribbon.

11. The method of claim 10, wherein step (a) is practiced such that the yarn end ribbon is wound about the core in layers of alternating helical turns.

12. The method of claim 10, wherein said step of interlacing is practiced using a pressurized fluid selected from pressurized air, steam or nitrogen.

13. The method of claim 10, wherein between steps (b) and (c) there is practiced the step of applying a finish oil to filaments of the yarn ends.

14. The method of claim 10, wherein prior to step (e) there is practiced the step of drawing the multiple yarn ends.

15. The method of claim 14, wherein said converging step (d) is practiced prior to said drawing step.

16. The method of claim 14, wherein said converging step (d) is practiced after said drawing step.

* * * * *